US006880376B1

(12) United States Patent
Ko

(10) Patent No.: US 6,880,376 B1
(45) Date of Patent: Apr. 19, 2005

(54) ANTI-TWIST KEY LOCK WITH CHANGEABLE LOCKING DEVICE

(76) Inventor: Barshi Ko, P.O. Box 2-83 Pan-chiao, Taipei Hsien (TW) 220

( * ) Notice: Subject to any disclaimer, the term of this patent is extended or adjusted under 35 U.S.C. 154(b) by 0 days.

(21) Appl. No.: 10/713,607

(22) Filed: Nov. 12, 2003

(51) Int. Cl.[7] ..... E05B 29/04; E05B 17/14

(52) U.S. Cl. ..... 70/366; 70/368; 70/369; 70/371; 70/416; 70/424; 70/455

(58) Field of Search ..... 70/365, 366, 416, 70/417, 419, 453, 454, 367–372, 375, 379 R, 70/379 A, 380, 381, 423, 424, 455

(56) References Cited

U.S. PATENT DOCUMENTS

| | | | | | |
|---|---|---|---|---|---|
| 1,414,348 | A | * | 5/1922 | Falk | 70/419 |
| 1,637,953 | A | * | 8/1927 | Maxwell | 70/367 |
| 1,674,513 | A | * | 6/1928 | Jacobi | 70/373 |
| 2,059,129 | A | * | 10/1936 | Maxwell et al. | 70/493 |
| 2,563,950 | A | * | 8/1951 | Martin | 70/452 |
| 3,863,476 | A | * | 2/1975 | Patriquin | 70/419 |
| 4,742,703 | A | * | 5/1988 | DeWalch et al. | 70/366 |
| 4,838,055 | A | * | 6/1989 | Gallagher | 70/208 |
| 4,866,964 | A | * | 9/1989 | Hall | 70/369 |
| 4,918,950 | A | * | 4/1990 | Foshee | 70/38 A |
| 4,998,953 | A | * | 3/1991 | Wilkin | 70/452 |
| 5,020,349 | A | * | 6/1991 | Lee | 70/491 |
| 5,038,589 | A | * | 8/1991 | Martin | 70/368 |
| 5,212,972 | A | * | 5/1993 | Kincaid et al. | 70/208 |
| 5,345,794 | A | * | 9/1994 | Jenks | 70/14 |
| 5,410,899 | A | * | 5/1995 | McConnell | 70/370 |
| 5,802,896 | A | * | 9/1998 | Tsai | 70/417 |
| 5,987,942 | A | * | 11/1999 | Ichinose | 70/208 |
| 6,058,752 | A | * | 5/2000 | Feder | 70/419 |
| 6,105,405 | A | * | 8/2000 | Westwinkel | 70/371 |
| 6,185,966 | B1 | * | 2/2001 | Chen | 70/366 |
| 6,523,378 | B1 | * | 2/2003 | Kuo | 70/360 |
| 6,568,229 | B1 | * | 5/2003 | Heinrich | 70/370 |

FOREIGN PATENT DOCUMENTS

FR 1573494 * 7/1969

* cited by examiner

*Primary Examiner*—Lloyd A. Gall

(57) ABSTRACT

This invention relates to an anti-twist key lock with changeable locking device, the anti-twist key lock having a key lock case, on the circumference of the key lock case having a slit and an opposite inner groove. A locking tumbler set is installed in the key lock case for interlocking the lock bolt and a front plug with receiving groove is inserted into the open end of the key lock case, then using an U-shape locating retainer to insert into the receiving groove of the front plug from the slit on the key lock case to locate the front plug and make it can be rotated freely to prevent the key lock from attacking or twisting to unlock by vandals or thieves, furthermore, the locking tumbler set can be changed by removing the U-shape locating retainer with a special tool.

3 Claims, 2 Drawing Sheets

ANTI-TWIST KEY LOCK WITH CHANGEABLE LOCKING DEVICE

BACKGROUND OF THE INVENTION (1) Field of the Invention

This invention relates to an anti-twist key lock with changeable locking device, especially a key lock which having revolving front plug to prevent it from twisting or knocking by vandals or thieves to unlock or break up.

(2) Description of the Prior Art

In order to protect individual's life and property, various safety locks are used widely in our daily life. The conventional safety lock almost having a hollow lock case in which an interlock tumbler set is installed therein, the key can be inserted into the front end of the hollow lock case to actuate the interlock tumbler set, further, the rear end of the hollow lock case being covered with a back plug to locate the interlocking tumbler set, and a plurality of screws being screwed through the circumference of the hollow lock case into the back plug to fix it. However, the back plug may apart from the hollow lock case by knocking violently the front end of the key lock assembly. Accordingly, an improved key lock assembly has been developed in present, the key lock assembly having a hollow lock case, the back end of the hollow lock case being closed, the front open end of the hollow lock case being covered with a front plug. The front plug is fixed on the hollow lock case by means of a plurality of screws, further, the center of the front plug having a through hole for inserting the key into the interlocking tumbler set. Such kind of safety lock can prevent vandals or thieves from knocking the plug to unlock or break up the lock, however, the vandals or thieves can insert a tool into the through hole of the front plug to twist violently to break the lock.

SUMMARY OF THE INVENTION

It is therefore the main object of this invention to provide an anti-twist key lock with changeable locking device, the anti-twist key lock having a key lock case, the back end of the key lock case being closed, the circumference of the front open end of the key lock case having a slit and an opposite inner groove. A locking tumbler set is installed in the key lock case for interlocking the lock bolt, and a front plug with receiving groove being inserted into the open end of the key lock case, then using an U-shape locating retainer to insert into the receiving groove of the front plug from the slit to locate the front plug and make it can be rotated freely to prevent the key lock from knocking or twisting to unlock or break up.

BRIEF DESCRIPTION OF THE DRAWINGS

In the drawings, which illustrate the preferred embodiments and modes of operation of the invention, and in which like reference characters designate the same or similar parts throughout the several views.

DETAILED DESCRIPTION OF THE PREFERRED EMBODIMENTS

Figure 1:
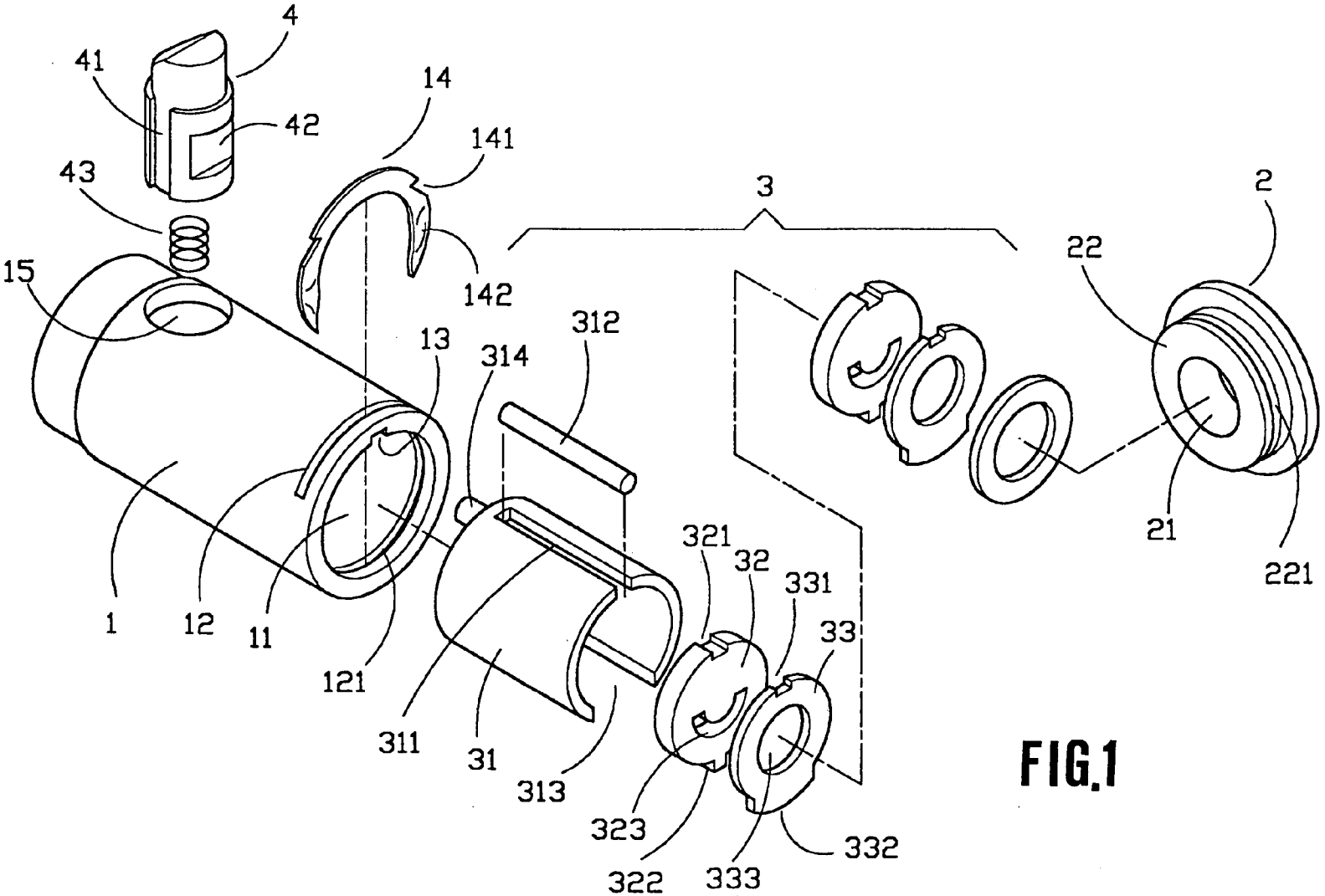
FIG. 1 is an exploded view showing an anti-twist key lock with changeable locking device of this invention.
Figure 3:
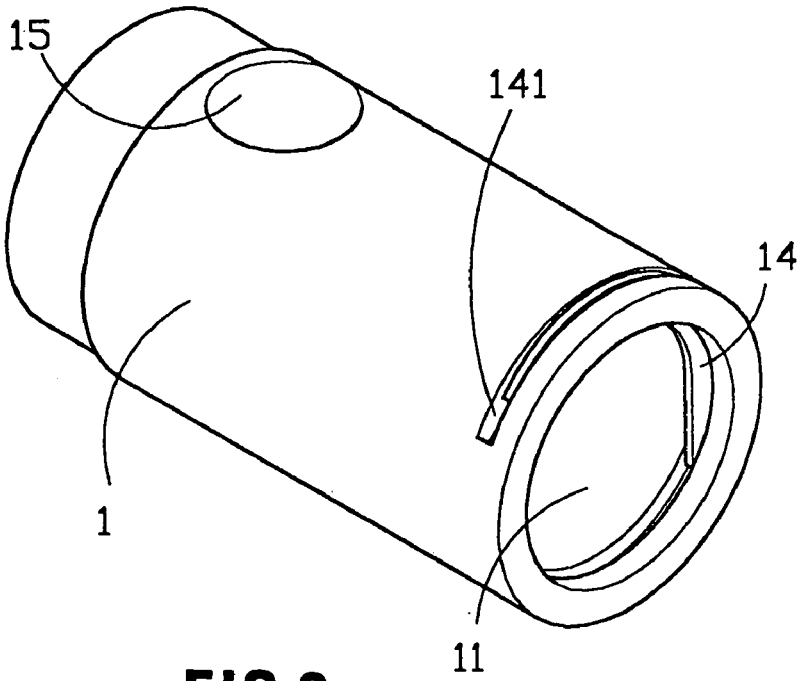
FIG. 3 is a perspective view showing the combination of the key lock case and the locating retainer of this invention.
Figure 2:
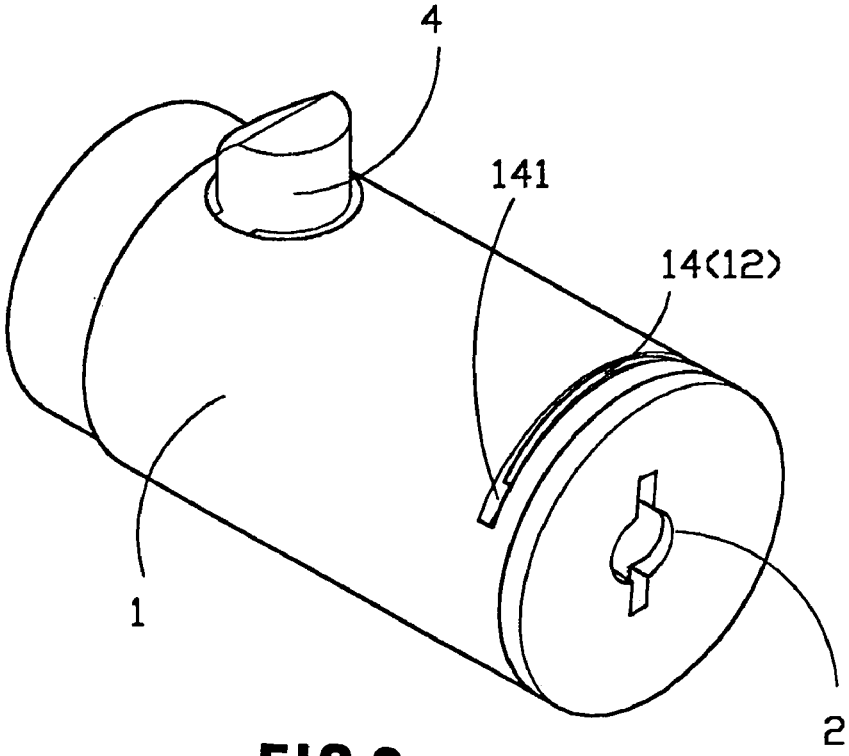
FIG. 2 is a perspective view of this invention.

Referring to FIG. 1 to FIG. 3, the present invention, an anti-twist key lock with changeable locking device, is composed of a key lock case (1), a front plug (2), a locking tumbler set (3), a lock bar (4) and a locating retainer (14); wherein the key lock case having a close end and an open end (11), the circumference of the open end having a slit (12) and a opposite inner groove (121), the inner circumference of the open end (11) having a longitudinal groove (13), furthermore, the circumference of the key lock case (1) near to the close end having a through hole (15). The side of the front plug (2) have a fitting part (22), the circumference of the fitting part having a receiving groove (221), the center of the front plug (2) having a key hole (21). The locking tumbler set is composed of a hollow carrier (31) and a plurality of tumbler disks (32) and space disks (33), the circumference of the hollow carrier (31) having a longitudinal aperture (311) and a locating aperture (313), the rear end of the hollow carrier (31) having an interlocking post (314). Each tumbler disk (32) has a notch (321), a segmental flange (322) and a key slot (323), and each space disks (33) also having a second notch (331), a second segmental flange (332) and a through key hole (333). The lock bar (4) is installed in the through hole (15), and a compression spring (43) being deposited at the bottom of the lock bar (4) to push it outwardly, further, the circumference of the lock bar (4) having a longitudinal guiding groove (41) and a concave part (42) respectively.

The tumbler disks (32) and the space disks (33) is deposited in sequence in the hollow carrier (31), further, to make the notches (321) (331) of the tumbler disks (32) and the space disks (33) aim to the longitudinal aperture (311), then inserting a connecting pin (312) into the gap between the notches (321) (331) and the longitudinal aperture (311) to connect each other. The assembled hollow carrier (31) can be pushed into the key lock case (1), meanwhile, to make the guiding groove (41) fit on a guiding rail (not shown in the figures) and make the interlocking post (314) extend to the concave part (42) of the locking bar (4). The fitting part (22) of the front plug (2) can be pushed into the front open end (11) of the key lock case (1), then inserting the U-shape locating retainer (14) into the receiving groove (221) of the front plug (2) through the slit (12) to locate the front plug (2) and make it can be rotate freely, the end of the locating retainer (14) being inserted into the inner groove (121) of the key lock case (1). To use a key to insert into the locking tumbler set (3) and rotate the locking post (314) to push the locking bar (4) inwardly or outwardly to unlock or lock.

Two sides of the locating retainer (14) is formed into wavy shape (142) so as to make it can be supported on the wall of the slit (12) and the inner groove (121) firmly, further, on the locating retainer (14) having two retaining grooves (141), then the operator can use a special tool to insert into the retainer grooves (141) to take out the locating retainer (14).

According, the front plug (2) can be rotated freely when we twisting it, thus the above anti-twist key lock can prevent the vandals or thieves from twisting or knocking the front plug to unlock or break up the key lock, furthermore, the tumbler disks (32) and the space disks (33) can be changed or replaced with new one freely by taking out the locating retainer (14).

It is understood by those skilled in the art that the forgoing description is a preferred device and that various changes and modifications may be made in the invention without departing from the spirit and scope thereof.

I claim:

1. An anti-twist key lock with changeable locking device, which comprising:

a key lock case, the key lock case having a closed end and an open end, the circumference of the open end having a slit and an opposite inner groove, the circumference of the key lock case near to the closed end having a through hole;

a locking bar installed in the said through hole and a compression spring deposited at bottom of the locking bar to push it outwardly;

a locking tumbler set installed in said key lock case, the locking tumbler set having an interlocking post formed at its end, the interlocking post can be rotated by a key to push the locking bar inwardly or outwardly;

a front plug, one side of the front plug having a fitting part, the circumference of the fitting part having a receiving groove, the center of the front plug having a key hole, the fitting part of the front plug can be pushed into said open end of the key lock case;

a locating retainer, the locating retainer can be inserted through said slit into said receiving groove to clip the front plug and make it capable of being rotated freely.

2. An anti-twist key lock with changeable locking device as claimed in claim 1, wherein two sides of the locating retainer are formed into wavy shape such that it can be supported in said slit and said inner groove.

3. An anti-twist key lock with changeable locking device as claimed in claim 1, wherein the locating retainer has a plurality of retaining grooves.

* * * * *